United States Patent [19]

Forberger

[11] 4,403,547

[45] Sep. 13, 1983

[54] METHOD OF PRINTING INTELLIGIBLE INFORMATION

[75] Inventor: Steven C. Forberger, Lancaster, Pa.

[73] Assignee: RCA Corporation, New York, N.Y.

[21] Appl. No.: 328,402

[22] Filed: Dec. 7, 1981

[51] Int. Cl.[3] ..... B41M 3/00

[52] U.S. Cl. ..... 101/170; 101/41; 101/150; 101/163; 101/426

[58] Field of Search ..... 101/41, 44, 301, 324, 101/318, 337, 335, 327, 328, 364, 375, 333, 35, 36, 37, 150, 170, 163, 154, 426

[56] References Cited

U.S. PATENT DOCUMENTS

| | | | |
|---|---|---|---|
| 2,166,138 | 7/1939 | Gundlach | 101/170 X |
| 2,832,282 | 4/1958 | Munson | 101/41 |
| 3,096,184 | 7/1963 | Gallup | 106/20 |
| 3,304,861 | 2/1967 | Magid | 101/170 X |
| 3,680,236 | 8/1972 | Deal et al. | 40/2.2 |
| 3,910,183 | 10/1975 | Noren et al. | 101/41 |
| 3,916,784 | 11/1975 | Dubuit | 101/41 |
| 4,288,719 | 9/1981 | Hernqvist | 29/2 |

*Primary Examiner*—Clifford D. Crowder
*Attorney, Agent, or Firm*—E. M. Whitacre; D. H. Irlbeck; L. Greenspan

[57] ABSTRACT

A shallow depression in a printing plate is filled with a viscous printing medium. Then, a transfer surface having the desired geometric pattern contacts the printing medium and thereby coats the surface with the medium. The coated transfer surface is then contacted with a receiving surface whereby medium in the desired pattern is transferred to the receiving surface. This method can be practiced with the same plate and at the same time as another, different transfer printing method.

10 Claims, 6 Drawing Figures

Fig. 1
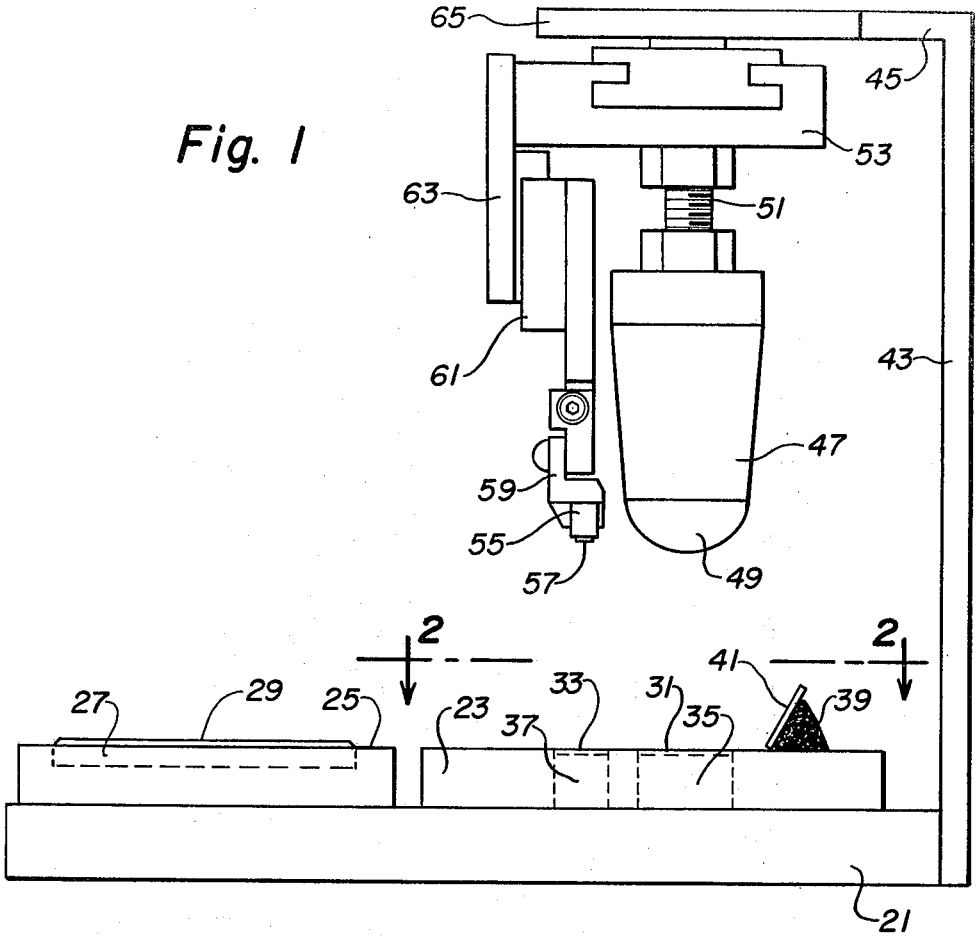
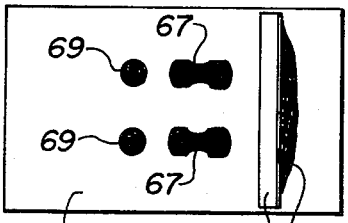
Fig. 2
Fig. 3
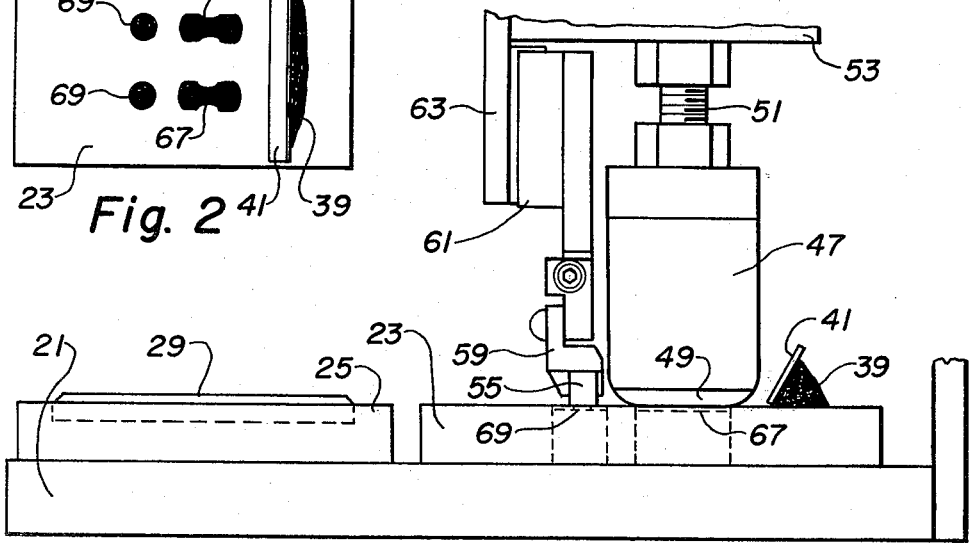

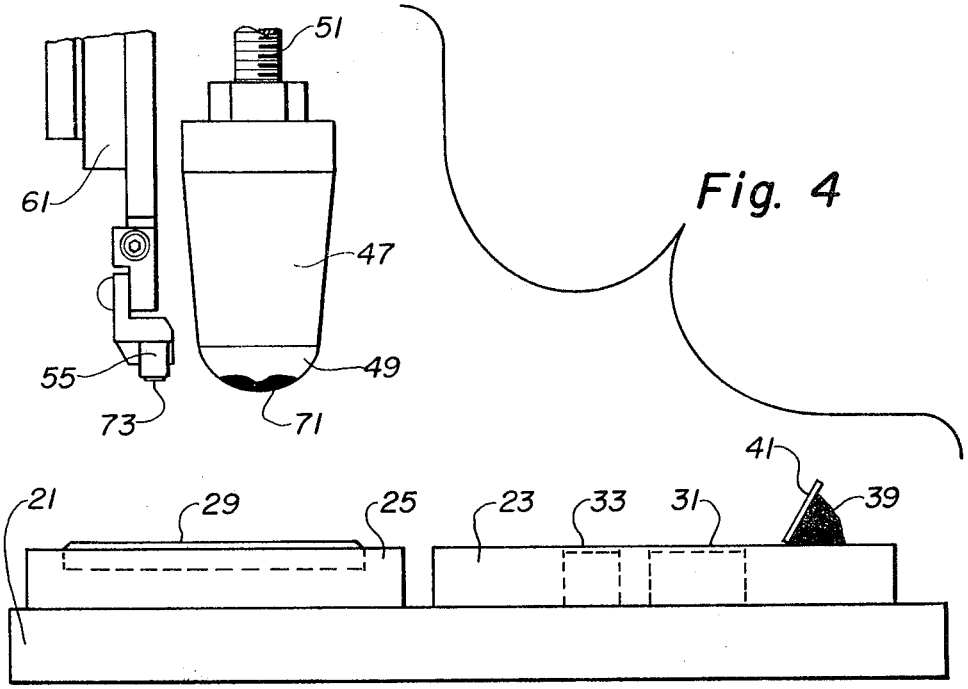
Fig. 4
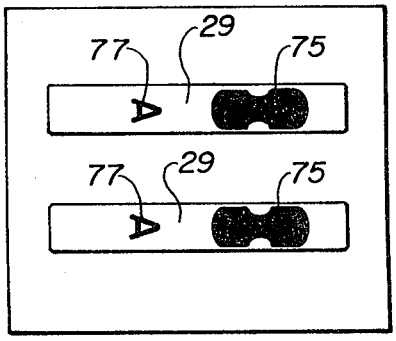
Fig. 6
Fig. 5
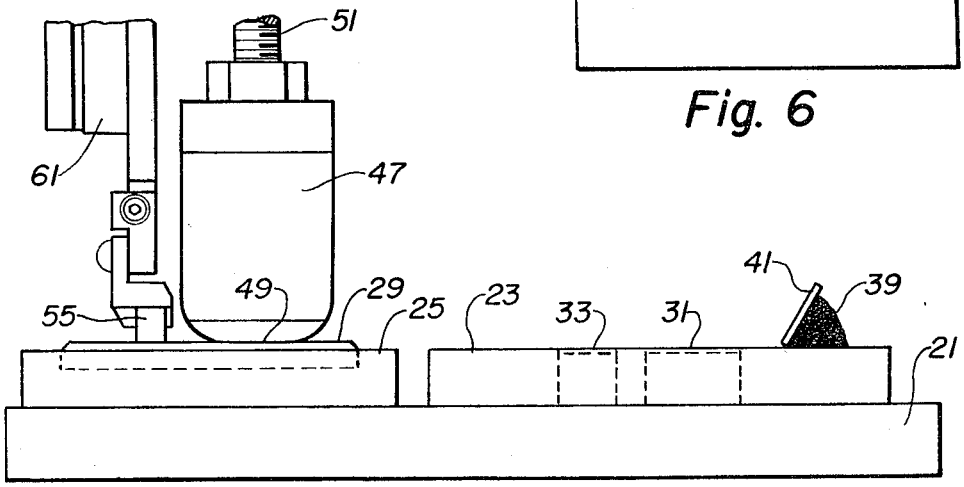

METHOD OF PRINTING INTELLIGIBLE INFORMATION

BACKGROUND OF THE INVENTION

This invention relates to a novel method for printing intelligible information, particularly, although not exclusively, to printing an identification marking on the surface of a rigid body.

Many electron tubes are made by providing a vacuum-tight envelope and then sealing an electron-gun mount assembly into the envelope. Most factories have not one but many different electron-gun mount assemblies in stock and in process, which assemblies are used on the different tubes that are assembled. These assemblies are very similar in appearance and require identification marks on them to prevent mixups.

It has been proposed previously to print the identifications marks directly on the support rods of the mount assembly by a transfer process. The rods are rigid bodies, usually of glass, with somewhat irregular surfaces. The marks are to be printed at the same time as an arc-suppressing conductive patch is printed. In the prior transfer process, shallow depressions the shape of the desired marks in a plate are filled with viscous printing medium as by doctor blading. Then, a resilient ball having a nonabsorbent surface is impressed over the depressions, transferring printing medium in the desired shape to the surface of the ball. Then, the ball is impressed onto the receiving surface thereby transferring medium in the shape of the desired marks.

This prior method has disadvantages as well as advantages. A different plate is required for each different marking, requiring a large inventory of plates as well as separate setups for each different plate. The depressions in the plates are etched chemically or electrically, and after relapping, as is required from time to time, must be re-etched to the required depth. Thus, the plates, their maintenance, and their use are more expensive than is desirable.

SUMMARY OF THE INVENTION

In the novel method, a shallow depression in a printing plate is filled with a viscous printing medium. Then, a transfer surface having the desired geometric pattern, such as resilient typographic type, is contacted with the printing medium whereby the surface is coated with the medium. The coated transfer surface is removed from the depressed area and is contacted with a receiving surface whereby printing medium in substantially the desired geometric pattern is transferred to the receiving surface.

The novel method can be practiced with the same plate and at the same time as the above-described prior transfer method. In such case, the depression used for the present method is preferably much shallower than the depression used for the prior method. In this way, a buildup of excess medium on the transfer surface can be minimized, while the thickness of the pattern produced by the prior method can be optimized.

BRIEF DESCRIPTION OF THE DRAWINGS

FIG. 1 is a side elevational view of an apparatus for practicing the novel method with the transfer surfaces in retracted positions over the printing plate.

FIG. 2 is a plan view of the printing plate shown in FIG. 1 along section line 2—2 after it has been filled with printing medium.

FIG. 3 is a fragmentary side elevational view of the apparatus shown in FIG. 1 with the transfer surfaces in extended positions in contact with the printing medium.

FIG. 4 is a fragmentary side elevational view of the apparatus shown in FIG. 1 with the transfer surfaces in retracted positions over the receiving surfaces.

FIG. 5 is a fragmentary side elevational view of the apparatus shown in FIG. 1 with the transfer surfaces in extended positions in contact with the receiving surfaces.

FIG. 6 is a plan view of the receiving surfaces and holding fixture after the transfer of printing medium has been completed.

DETAILED DESCRIPTION OF THE PREFERRED EMBODIMENT

The steps of the novel method are exemplified below with reference to FIGS. 1 to 6 by the forming and transfer of metal resinate patterns to the surfaces of two electrically-conductive support rods. Such rods, or glass beads as they are referred to in the art, are used in electron-gun mount assemblies for vacuum electron tubes. Such mount assemblies are described in the prior art, for example, in U.S. Pat. No. 4,288,719 issued Sept. 8, 1981 to K. G. Hernqvist and in U.S. application Ser. No. 325,050 filed Nov. 25, 1981 by P. J. Messineo and entitled, "Electron-Gun Mount Assembly Having a Coated Identification Marking Thereon." Two or more glass beads are used in each mount assembly. Each bead is about 10 mm (millimeters) wide by about 48 mm long by about 4 mm thick.

The apparatus shown in FIG. 1 comprises a table 21 on which is mounted a printing plate 23 and a bead-holding fixture 25. The fixture 25 has recesses into which are placed two glass beads 27 (as described above) with their receiving surfaces 29 facing upward. The plate 23, shown in FIG. 2, has two first depressions 31, each about 0.068 mm (2.7±0.2 mils) deep, whose shapes are directly related to the pattern to be printed. The plate 23 also has two second depressions 33, each about 0.015 mm (0.6±0.2 mils) deep, whose circular shape is arbitrary and unrelated to the pattern to be printed. The depressions 31 and 33 are made by machining apertures of the desired shape through the body of the platen 23 and then inserting first plugs 35 and second plugs 37 respectively in the apertures to leave the desired depths for the depressions.

A post 43 extends upward from the table 21 to an outwardly-extending arm 45, which supports the entire transfer assembly over the table 21. The transfer assembly includes, for printing a first pattern, a resilient pad 47, made for example of silicone, having a spherical first transfer surface 49, and a pad support 51, which is attached to a common support 53. The first transfer surface 49 has an arbitrary shape, which is unrelated to the first pattern to be printed, but is large enough to receive both of the first patterns from the plate 23. The transfer assembly includes, for printing a second pattern, two sets of resilient type 55 (one behind the other as shown in FIGS. 1, 3, 4 and 5) having second raised transfer surfaces 57, whose shapes are directly related to the second patterns to be printed, a type support 59, a ball slide 61 permitting vertical movement of the type support, and a slide support 63, which is attached to the common support 53. The common support 53 is connected to the arm 45 through an extending means 65, which can move the entire transfer assembly up or down. Not shown is a horizontal moving means for moving the entire transfer assembly to positions either over the printing plate 23 or the bead-holding fixture 25.

The apparatus is operated as follows to print different first and second patterns on the beads 27. The beads 27 are inserted into the fixture 25 with the receiving surfaces 29 facing upward. A doctor blade 41 is operated horizontally to push a quantity of printing medium 39 across the surface of the plate 23, filling the first and second depressions 31 and 33 therein with printing medium 67 and 69 level with the surface of the plate 23. It is noteworthy that the thicknesses of the medium 67 in the first depressions 31 are more than three times the thicknesses of the medium 69 in the second depressions 33.

Next, the extending means 65 is operated to lower the entire transfer assembly until the first and second transfer surfaces 49 and 57 are in contact with the plate 23, as shown in FIG. 3. In this position, the first transfer surface 49 is impressed into the first depression 31 thereby contacting the medium 67 therein; and the second transfer surface 57 only lightly contacts the medium 69 in the second depressions 33, since the ball slide 61 does not permit any pressure to be applied to the type 55 above the weight of the parts between the second transfer surface 57 and the ball slide 61.

Next, the extending means 65 is operated to retract the transfer assembly back to the position shown in FIG. 1. Then, the moving means (not shown) is operated to move the transfer assembly to a position over the bead-holding fixture 25, as shown in FIG. 4. Also shown in FIG. 4 is a first coating 71 in the first pattern on the first transfer surface 49, and a second coating 73 in the second pattern on the second transfer surface 57.

Next, the extending means 65 is operated to lower the transfer assembly until the coatings 71 and 73 on the first and second transfer surfaces 49 and 57 respectively contact the receiving surfaces 29 of the beads 27 as shown in FIG. 5. In this position, the first transfer surface 49 is impressed onto the receiving surfaces 29 with considerable pressure; and the second transfer surface 57 only lightly contacts the receiving surfaces 29 since the ball slide 61 prevents any pressure to be applied above the weight of the parts. With this contact, printing medium from the first and second coatings 71 and 73 transfers to the receiving surfaces 29.

Next, the extending means 65 is operated to retract the transfer assembly, and the moving means (not shown) is operated to move the transfer assembly back to the position shown in FIG. 1.

FIG. 6 shows the beads 27 in the holder 25 just after the transfer is completed. Printing medium in a first pattern 75 and in a second pattern 71 appears on both beads 27.

In this example, the printing medium is Hanovia Liquid Bright Platinum No. 5, which is a metal resinate marketed by Englehard Industries, Inc., East Newark, N.J. Other resinates are available for producing alloys of silver, gold and other metals besides the platinum-gold alloy produced with the foregoing resinate. The resinate-coated bead is then heated at about 500° C. in air to volatilize organic matter and to cure the coating to produce the desired metal alloy adhered to the surface of the bead. The metalized bead may then be used in any of the known beading processes for assembling an electron-gun mount assembly.

Generally, the metallic areas produced from the first patterns in the example have the properties of the electrically-conducting patches disclosed in the above-cited Hernqvist patent. They are typically about 1000 A thick, are tapered in thickness near the edges thereof, and have resistivities of about 50 ohms per square. The metallic markings produced from the second patterns of the example are much thinner and therefore have much higher resistivities. Thicknesses and resistivities are matters of design choice.

In the example, each depression is described as having a uniform depth. This results in the transfer of a substantially uniform thickness of printing medium. As another alternative, the depth of each depression may be variable to provide a custom profile. This will transfer a variable thickness of printing medium. Where a metal resinate is transferred as in the example, the ultimate coating will have a variable resistivity related to the variation in thickness of the transferred printing medium. Thus, the thicknesses and other properties of the final pattern coatings may be tailored by the design of the depths and profiles of the depressions in the plate.

Besides metal resinates, other printing media may be used in the novel method, there being no criticality to the composition of the printing medium. However, the printing medium should be viscous so that it may be conveniently doctor bladed into the depressions in the plate and may be transferred conveniently to the first and second transfer surfaces.

The first transfer surface is the surface of a resilient body with a spherical surface which is nonabsorbent of the primary medium. This type of transfer process has been described elsewhere and need not be described in further detail here. The second transfer surface is a rubber stamper, which is raised typographic characters which may be any character or a combination of characters that is alphabetical or numerical or symbolic. The surface of the stamper is nonabsorbent to the printing medium, and the body of the stamper is resilient, permitting a reasonable amount of flexibility when the first transfer surface contacts the receiving surface. In addition to alpha numeric characters, intelligible information in the form of bar codes or other types of codes may also be used.

The first transfer surface and the first pattern may be omitted completely from the above-described example. This leaves only the second transfer surface and the second pattern to be transferred. The unusual feature here is the method for providing the coating upon the second transfer surface. This method provides a carefully-controlled thickness of viscous printing medium such that there is a minimum of buildup of excess printing medium on the side of the raised typographic type. This permits longer runs and better definition to the transferred pattern. Where the first and second patterns are transferred as described above in the example, an additional feature is the fact that two different modes of transfer are conducted simultaneously with the same method for providing a metered amount of printing medium to each of the printing methods. Also, the shape of the pattern to be transferred does not appear on the same physical body. That is, the first pattern appears in the plate, while the second pattern appears in the transfer surface.

The printing plate, in the example, is a metal plate having apertures therethrough of the desired pattern outline, and plugs inserted in the apertures to leave the depths for the depressions. Where the surface of the platen becomes worn or scratched, the plate can be resurfaced, as by lapping, and the plugs can be reset to leave the desired depths for the depressions. Also, where the depth is variable, the variation can be in the surface of the plug. The depths of the depressions are in the range of about 0.0025 to 0.25 mm (0.1 to 10 mils) deep.

What is claimed is:

1. A method of printing intelligible information upon a receiving surface comprising (1) providing a plate having a nonporous plate surface with a shallow depressed area therein, said depressed area having an arbitrary shape that is unrelated to the information to be printed, (2) filling said depression area with a viscous printing medium, (3) providing a transfer surface having a geometric pattern conveying intelligible information, (4) translating said transfer surface in a direction that is substantially normal to said plate surface into contact with said medium in said filled depressed area, whereby said transfer surface is coated with said printing medium, (5) removing said coated transfer surface from said filled depressed area, and (6) translating said coated transfer surface in a direction that is substantially normal to said receiving surface into contact with said receiving surface whereby printing medium in substantially said geometric pattern is transferred from said transfer surface to said receiving surface.

2. The method defined in claim 1 wherein said depressed area is about 0.1 to 1.0 mil deep.

3. The method defined in claim 1 wherein said depressed area is filled by doctor blading.

4. The method defined in claim 1 wherein said transfer surface is a raised nonporous surface portion of a resilient, compressible body.

5. The method defined in claim 1 wherein said receiving surface is a nonporous surface portion of a rigid body.

6. A method of printing substantially simultaneously two different patterns on a receiving surface by two different printing procedures comprising (1) providing a plate having a nonporous plate surface with at least two shallow depressed areas therein, each of said areas having a substantially uniform depth, the first of said areas having a prescribed first shape directly related to the first pattern to be printed, and the second of said areas having an arbitrary second shape unrelated to the second pattern to be printed, (2) filling each of said depressed areas to about their uniform depths with a viscous printing medium, (3) impressing a first transfer surface into contact with the printing medium in said first depressed area, said first transfer surface having a geometry unrelated to said first pattern to be printed whereby said first transfer surface is coated with said printing medium and, at the same time, contacting a second transfer surface with the printing medium in said second depressed areas, said second transfer surface having a geometry directly related to said second pattern to be printed, whereby said second transfer surface is coated with said printing medium, (4) removing said coated first transfer surface from contact with printing medium in said first depressed area and removing said coated second transfer surface from contact with printing medium in said second depressed area, and then (5) impressing said coated first transfer surface and contacting said coated second transfer surface upon a receiving surface, whereby printing medium in said first pattern and in said second pattern is deposited upon said receiving surface.

7. The method defined in claim 6 wherein the second of said areas is substantially shallower than the first of said areas.

8. The method defined in claim 6 wherein both of said first and second areas are filled with the same printing medium.

9. The method defined in claim 6 wherein said plate surface is substantially planar, said first transfer surface is substantially spherical and said second transfer surface is substantially planar.

10. The method defined in claim 9 wherein said plate surface and said receiving surface are each rigid and nonporous, and said first and second transfer surfaces are each nonporous and supported on resilient backings.

* * * * *